US005431531A

United States Patent [19]

Nozawa

[11] Patent Number: 5,431,531

[45] Date of Patent: Jul. 11, 1995

[54] LABEL PICKING UP DEVICE

[75] Inventor: Masayuki Nozawa, Tochigi, Japan

[73] Assignee: The Singer Company N.V., Curacao, Netherlands

[21] Appl. No.: 175,451

[22] Filed: Dec. 30, 1993

[30] Foreign Application Priority Data

Jun. 30, 1993 [JP] Japan ..... 5-041138 U

[51] Int. Cl.[6] ..... B65G 59/04

[52] U.S. Cl. ..... 414/796.6; 414/797

[58] Field of Search ..... 414/907, 788.2, 796.5, 414/796.6, 797

[56] References Cited

U.S. PATENT DOCUMENTS

| | | | |
|---|---|---|---|
| 2,467,493 | 4/1949 | Pabich | 414/796.6 |
| 3,822,024 | 7/1974 | Endter et al. | 414/796.6 |
| 3,999,666 | 12/1976 | Lloyd et al. | 414/796.6 |
| 5,106,260 | 4/1992 | Obrecht | 414/796.6 |

FOREIGN PATENT DOCUMENTS

| | | | |
|---|---|---|---|
| 7151 | 1/1986 | Japan | 414/796.5 |
| 1608001 | 11/1990 | U.S.S.R. | 414/796.5 |

*Primary Examiner*—Michael S. Huppert
*Assistant Examiner*—Thomas J. Brahan
*Attorney, Agent, or Firm*—McCormick, Paulding & Huber

[57] ABSTRACT

A label picking up device for drawing by suction the uppermost label from a plurality of labels accommodated in a pile in a label case by way of a vacuum suction unit and supplying the sucked label to a given sewing machine comprises a presser member which is inserted into the label case through a vertical opening portion formed on a side wall thereof for pressing the pile of the labels at an edge portion thereof in the label case from above at a given pressure and a peel-off plate for pushing out the uppermost label by rubbing the same on an edge portion of the upper surface thereof so as to release the same from being pressed down by the presser member. As a result, it is possible to draw the uppermost label by suction with certainty regardless of the weight of the label, the air permeability thereof, etc., and moreover supply the same to a given sewing position.

2 Claims, 5 Drawing Sheets

LABEL PICKING UP DEVICE

BACKGROUND OF THE INVENTION

1. Field of the Invention

The present invention relates to a label picking up device for supplying labels piece by piece to a given sewing machine.

2. Description and Problems of the Related Art

There is known a conventional label picking up device of this kind employing a vacuum suction method, according to which labels accommodated in a pile in a label case is drawn by a vacuum suction unit piece by piece for supplying the same to a given portion in a sewing machine. The labels bearing thereon, for example, the registered trademark of a manufacture to be sewn on clothes have various kinds of size, weight, material etc.

Such a conventional label picking up device, however, is constructed such that the uppermost label is drawn by a vacuum suction unit for transference while the second and later labels thereunder are separated from the sucked uppermost label only by gravity, which has a technical drawback that it is difficult to peel off the labels piece by piece by drawing the same by the vacuum suction unit stably and consequently an suction error is liable to occur since the labels are different in air permeability etc. according to size, weight, material etc. thereof.

Although the uppermost label alone should be drawn by suction from the labels piled in the label case, in practice it is difficult to supply the labels piece by piece to a given position in the sewing machine in a given posture with certainty since the second or later labels are drawn by suction together with the first one, no label is drawn, or the second label is displaced from the original position when the first one is drawn by suction due to adhesion therebetween.

SUMMARY OF THE INVENTION

The present invention has been made from a viewpoint of such a conventional technical problem to provide a label picking up device for drawing by suction the uppermost label 2 from a plurality of labels 2 accommodated in a pile in a label case 1 by way of a vacuum suction unit 24 and supplying the sucked label 2 to a given sewing machine, characterized in that the label picking up device comprises a presser member 8 which is inserted into the label case 1 through a vertical opening portion 1*d* formed on a side wall thereof for pressing the pile of the labels 2 at an edge portion thereof in the label case 1 from above at a given pressure and a peel-off plate 19 for pushing out the uppermost label 2 by rubbing the same on an edge portion of the upper surface thereof so as to release the same from being pressed down by the presser member 8.

The label picking up device can further comprise a vertically driving unit 22 for temporarily raising the presser member 8 for releasing the second and later labels 2 from being pressed down thereby after the uppermost label 2 is frictionally pushed out by the peel-off plate 19 and is released from being pressed down by the presser member 8.

In the label picking up device as set forth above, the peel-off plate 19 is operated while the presser member 8 presses down the pile of the labels 2 at an edge portion thereof in the label case 1 at a given pressure before the uppermost label is drawn by the vacuum suction unit.

The peel-off plate 19 pushes out the uppermost label 2 by rubbing the upper surface thereof from a side toward the other side so as to release the same from being pressed down by the presser member 8. The vacuum suction unit 24 draws by suction the label 2 which has been released from being pressed down by the presser member 8 in this way. At that time, the second and later labels 2 are pressed down by the presser member 8 so as to be prevented from being drawn by the vacuum suction unit 24 together with the uppermost label 2.

In case the label picking up device comprises the vertical driving unit 22, it temporarily raises the presser member 8 so as to release the second and later labels 2 from being pressed down thereby after the uppermost label 2 is frictionally pushed out by the peel-off plate 19 and is released from being pressed down by the presser member 8. Accordingly, the second and later labels 2 which are misaligned a little when the uppermost label 2 is frictionally pushed out by the peel-off plate 19 are elastically restored to their original positions.

PREFERRED EMBODIMENT OF THE INVENTION

An embodiment of the present invention will be described hereinafter.

Figure 1:
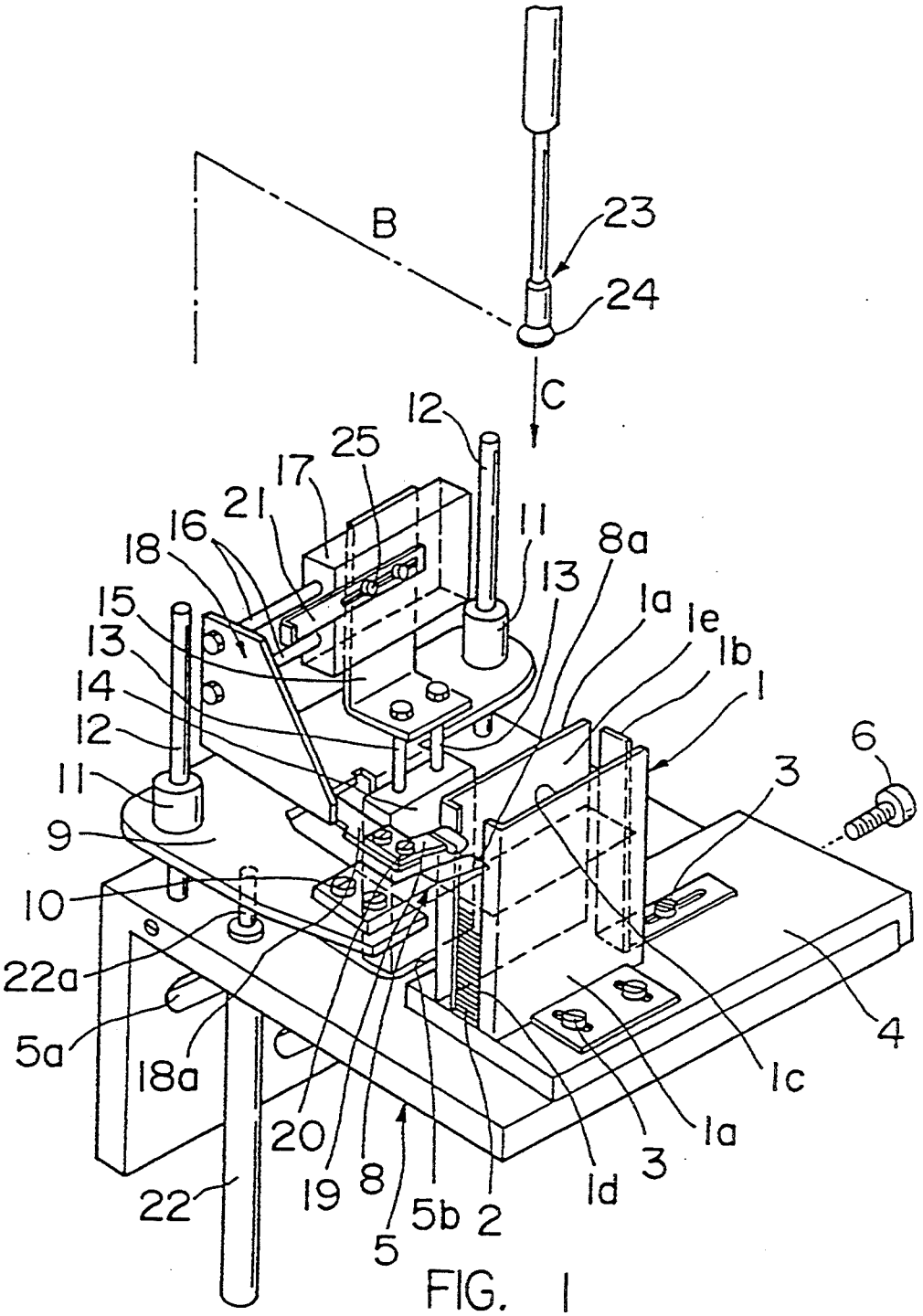
FIG. 1 is a perspective view of a label picking up device according to an embodiment of the present invention.
Figure 2:
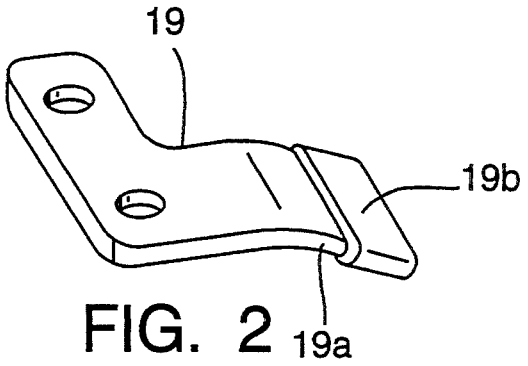
FIG. 2 is a perspective view showing a peel-off plate in FIG. 1.
Figure 3:
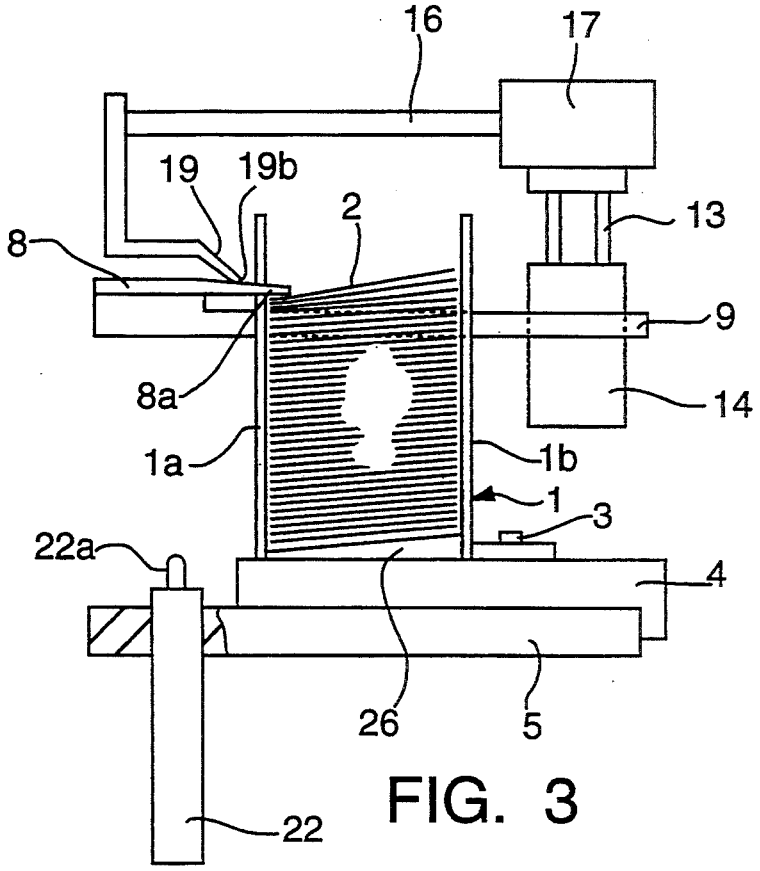
FIG. 3 is a partially omitted view of the label picking up device in FIG. 1.

FIGS. 1 to 9 show an embodiment of the present invention. In the figure denoted at 1 is a label case composed of a pair of main vertical walls 1*a*, 1*a* which have shapes of L in horizontal cross section and are arranged on a base 4 in such a way as to be adjustable left and right confronting with each other as illustrated in FIG. 1 and a secondary vertical panel wall 1*b* which is arranged between the sides of the pair of the main vertical walls 1*a*, 1*a*, having a comparatively wide aperture therebetween while the main vertical walls 1*a*, 1*a* have a comparatively narrow vertical opening portion 1*d* therebetween on the other side thereof. Accordingly, a storage space 1*e* for accommodating a plurality of labels therein is defined by the main vertical walls 1*a*, 1*a* and the secondary vertical wall 1*b*. The storage space 1*e* has no ceiling to form a label insertion port 1*c* thereabove and an inclining surface thereunder gradually inclining toward the opening 1*d* by way of a wedge-shaped member 26 as illustrated in FIG. 3.

One of the pair of the main vertical wall 1*a*, 1*a* is fixed to the base 4 by set screws 3 in such a way as to be adjustable in mounting position thereof and similarly the secondary vertical wall 1*b* is fixed to the base 4 by a set screw 3 in such a way as to be adjustable in mounting position thereof so as to conform the horizontal cross section of the storage space 1*e* to the size (width and length) of the rectangular labels 2 accommodated therein. The base 4 is fixedly mounted on a frame 5 by a screw 6 while the frame 5 is mounted on a sewing machine, not shown, by set screws, not shown, inserted through a mounting hole 5*a*. A plurality of labels 2 are inserted into the storage space 1*e* through the label insertion port 1*c* to be stored in a pile therein.

The contact portion 8*a* of the presser member 8 advances into the label case 1 through the opening 1*d* thereof to press the upper surface of an end portion of the labels 2 piled in the label case 1 by the contact portion 8*a* thereof which is formed gradually thinner toward the tip end thereof at a given pressure. The presser member 8 is mounted on the tip end portion of an L-shaped supporting plate 9 horizontally arranged on the frame 5 by set screws 10. The supporting plate 9 is guided in vertical movement by a pair of guide pins 12 which project upward from the frame 5 and are inserted into guide bushes 11 fixed to the both sides of the base portion thereof in such a way as to be vertically movable therein. The position of the supporting plate 9 on the guide pins 12 is determined by the height of the labels 2 piled in the label case 1 as described later, and the supporting plate 9 and the presser member 8 etc. integrally formed therewith gradually lower by gravity being guided by the guide pins 12 according as the decrease of the labels 2 in the label case 1 in number.

A reciprocating pneumatic cylinder 14 which is a vertical driving device is fixedly mounted on the central portion of the supporting plate 9, one end portion of an L-shaped mounting plate 15 is fixed to the tip end portions of a pair of piston rods 13 which are arranged to operate vertically, a reciprocating pneumatic cylinder 17 which is a horizontal driving device is fixed to the other end portion of the mounting plate 15 and a peel-off plate mounting plate 18 is fixed to the tip end portions of a pair of piston rods 16 which are arranged to operate horizontally. A peel-off plate 19 which is advanced into the label case 1 through the opening portion 1*d* by the operation of the pneumatic cylinder device 17 is fixed to the tip end portion 18*a* of the peel-off plate mounting plate 18 by set screws 20.

The peel-off plate 19 is bent at the central portion thereof as illustrated in FIG. 2 and the tip end portion 19*a* curved downward is covered by a cylindrical rubber having a bottom to form a rubber covering portion 19*b*. Accordingly, the peel-off plate 19 is driven upward or downward together with the peel-off plate mounting plate 18 by way of the mounting plate 15 and the pneumatic cylinder device 17 due to the operation of the pneumatic cylinder device 14 and is driven forward or backward together with the peel-off plate mounting plate 18 due to the operation of the pneumatic cylinder device 17 so as to move forward or backward in the opening portion 1*d* of the label case 1. The rubber covering portion 19*b* of the peel-off plate 19 contacts the upper surface of the presser member 8 adjacent to the contacting portion 8*a* thereof when the pneumatic cylinder devices are not activated.

When the pneumatic cylinder device 17 is retracted in a normal state wherein the pneumatic cylinder device 14 is retracted and the peel-off plate mounting plate 18 is lowered, the peel-off plate 19 is driven forward together with the peel-off plate mounting plate 18 so that the rubber covering portion 19*b* is displaced from the contacting portion 8*a* of the presser member 8 onto the labels 2 and consequently the peel-off plate 19 advances while rubbing the uppermost label 2 so as to frictionally push out the uppermost label 2 alone.

As the number of the labels 2 in the label case 1 is decreased, the presser member 8 and the supporting plate 9 lower together and the pneumatic cylinder device 14 fixed to the supporting plate 9, the mounting plate 15 and the pneumatic cylinder device 17 connected to the pneumatic cylinder device 14 and the peel-off plate mounting plate 18 and the peel-off plate 19 connected to the pneumatic cylinder device 17 also lower at the same time. Accordingly, the relation in height between the uppermost label 2 pressed by the presser member 8 and the tip end portion 19*a* of the peel-off plate 19 is stably maintained by the air pressure set in the pneumatic cylinder device 14 regardless of the number of the labels 2 in the label case 1, and moreover the pressure applied to the label 2 by the presser member 8 can be kept constant. Furthermore, an opening 5*b* is formed in the frame 5 in order to prevent the pneumatic cylinder device 14 from interfering with the frame 5 when the supporting plate 9 lowers.

Figure 4:
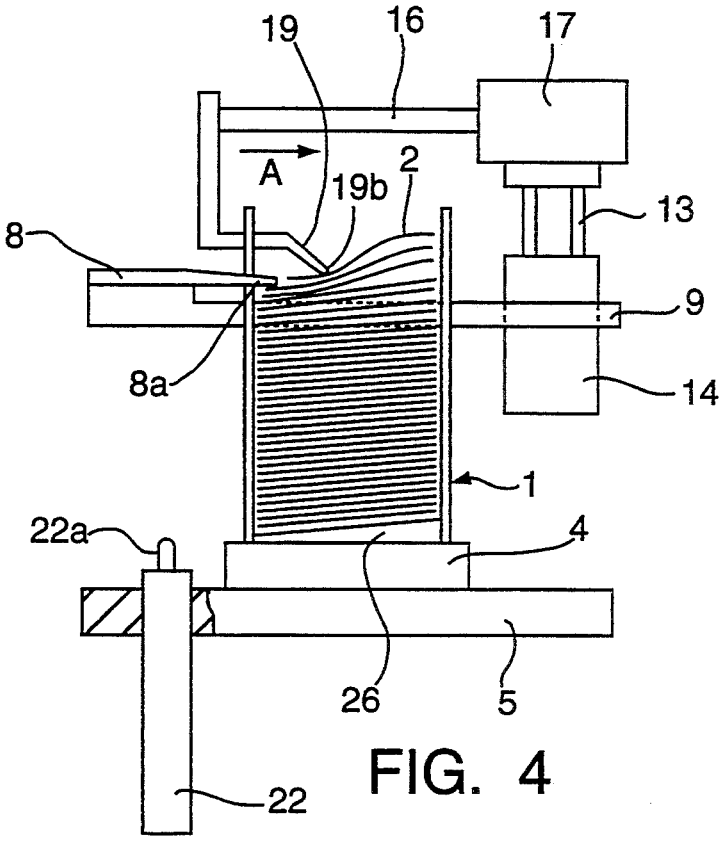
FIG. 4 is a view for explaining the operation of the label picking up device in FIG. 1.

Denoted at 21 is a stopper for stopping the peel-off plate 19. The stopper 21 is mounted on the pneumatic cylinder device 17 by screws 25 in such a way as to be adjustable forward or backward in projection. It is possible to properly set the stopping position of the peel-off plate 19 which is advanced into the label case 1 in the direction of the arrow A as illustrated in FIG. 4 in accordance with the kind of the labels 2.

Denoted at 22 is a pneumatic cylinder device which is a vertical driving device, and is fixedly mounted on the frame 5 adjacent to the guide pin 12 in such a way as to be able to contact the lower surface of the supporting plate 9 at the upper end portion of the piston rod 22*a* thereof which projects from the frame 5. When the pneumatic cylinder device 22 is operated forward, the presser member 8 which presses the label 2 in the label case 1 can be separated from the surface of the label 2 since the supporting plate 9 is pushed up by the piston rod 22*a* thereof. As a result, the misalignment of the second and later labels which takes place when the uppermost label 2 is frictionally pushed out by the peel-off plate 19 can be corrected by the resilient restoring force of the labels 2 per se while the labels 2 contact the secondary vertical wall 1*b* at the forward edges thereof.

Denoted at 23 is a label suction device which is fixedly mounted on a sewing machine body, not shown, of a sewing machine and is equipped with a driving unit, now shown. The vacuum suction unit 24 at the lower end portion of the label suction unit 23 is vertically and horizontally reciprocated between a given position of the sewing machine and a position above the central portion of the storage space 1*e* of the label case 1 as indicated by a chain line B and the vacuum suction unit 24 is vertically driven from a position above the central portion of the storage space 1*e* as indicated by a chain line C in FIG. 1. The vacuum suction unit 24 can draw the uppermost label 2 by suction from a negative pressure source such as a vacuum pump, not shown, when it is lowered to a position adjacent to the surface of the label 2.

The operation of the above embodiment will be described hereinafter with reference to FIGS. 3 to 9.

At first, the pressure member 8 presses down the upper surface of an end portion of the uppermost label 2 in the label case 1 by the contacting portion 8*a* thereof and the peel-off plate 19 is retracted while the rubber covering portion 19*b* at the tip end portion thereof contacts about the upper surface of the contacting portion 8*a* of the presser member 8 as illustrated in FIG. 3.

At this state, the pneumatic cylinder device 17 is operated backward to advance the peel-off plate 19. As a result, the covering portion 19*b* of the peel-off plate 19 advances from the upper surface of the contacting portion 8*a* of the pressure member 8 while rubbing the upper surface of the uppermost label 2 and consequently draws out an end portion of the label 2 by frictional force so as to release the same from being pressed down by the contacting portion 8*a* of the presser member 8 as illustrated in FIG. 4.

Since the storage space 1*e* has a lower surface gradually inclining downward toward the opening portion 1*d* by way of the wedge-shaped member 26, the peel-off plate 19 rubs the upper surface of the label 2 at the rubber covering portion 19*b* thereof gradually stronger as it advances horizontally. As a result, it is possible to extract a label 2 with certainty by properly setting the length of the stopper 21 so as to properly set the forward displacement of the peel-off plate 19 according to the kind of the label 2.

Figure 5:
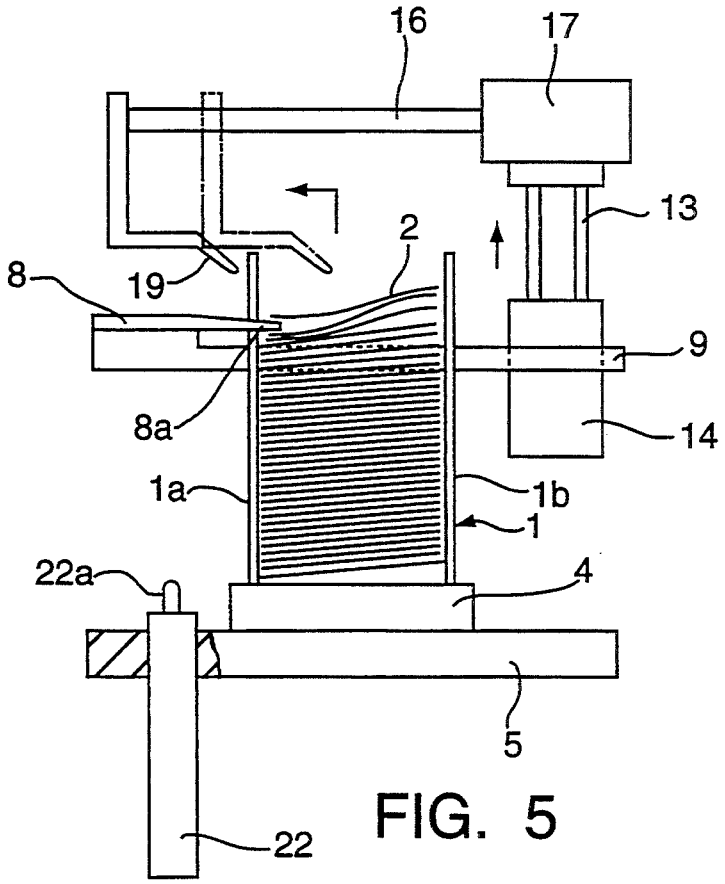
FIG. 5 is a view for explaining the operation of the label picking up device in FIG. 1.

After completion of separating a label 2, the pneumatic cylinder 14 is operated forward to raise the peel-off plate 19 as illustrated in FIG. 5. A label 2 which has been released from engaging the rubber covering portion 19*b* of the peel-off plate 19 is restored from the bent state by the resilient restoring force of the label 2 per se as it contacts the vertical wall 1*b* of the label case 1 at the forward edge thereof and is separated from the second label 2 to be put on the upper surface of the contacting portion 8*a* of the presser member 8 at one end portion thereof. Then the pneumatic cylinder device 17 is operated forward to retract the peel-off plate 19 to a position above its original position.

Figure 6:
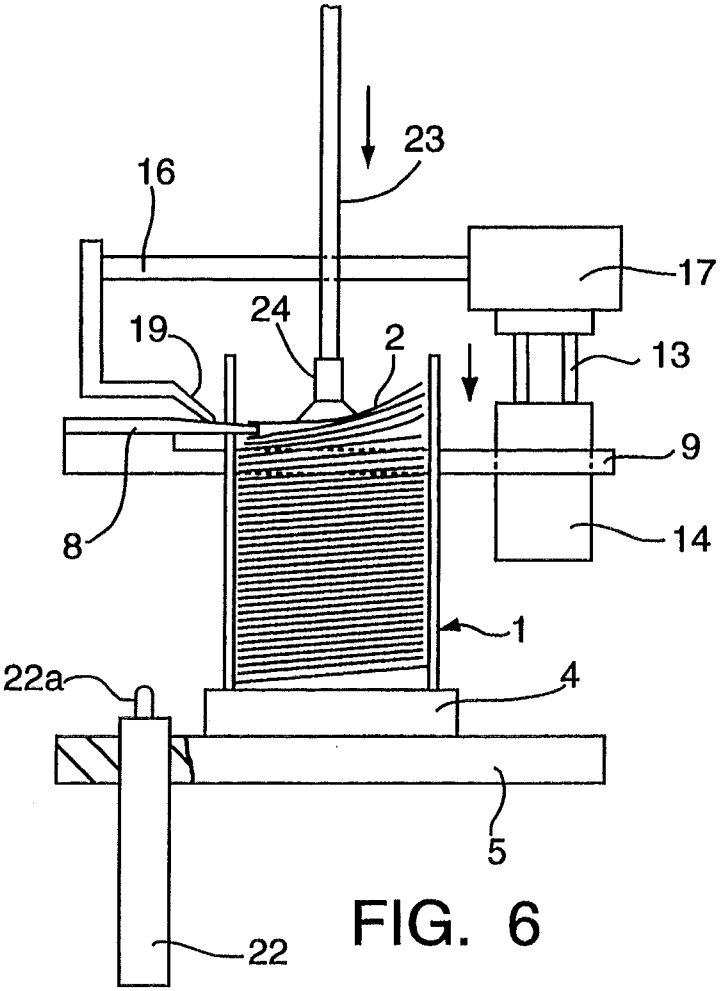
FIG. 6 is a view for explaining the operation of the label picking up device in FIG. 1.

The retracted peel-off plate 19 above its original position is lowered by the pneumatic cylinder device 14 to the original position where it contacts the upper surface of the presser member 8 about the contacting portion 8*a* thereof as illustrated in FIG. 6. At the same time, the vacuum suction unit 24 lowers to draw the uppermost label 2 by suction from the negative pressure source.

Figure 7:
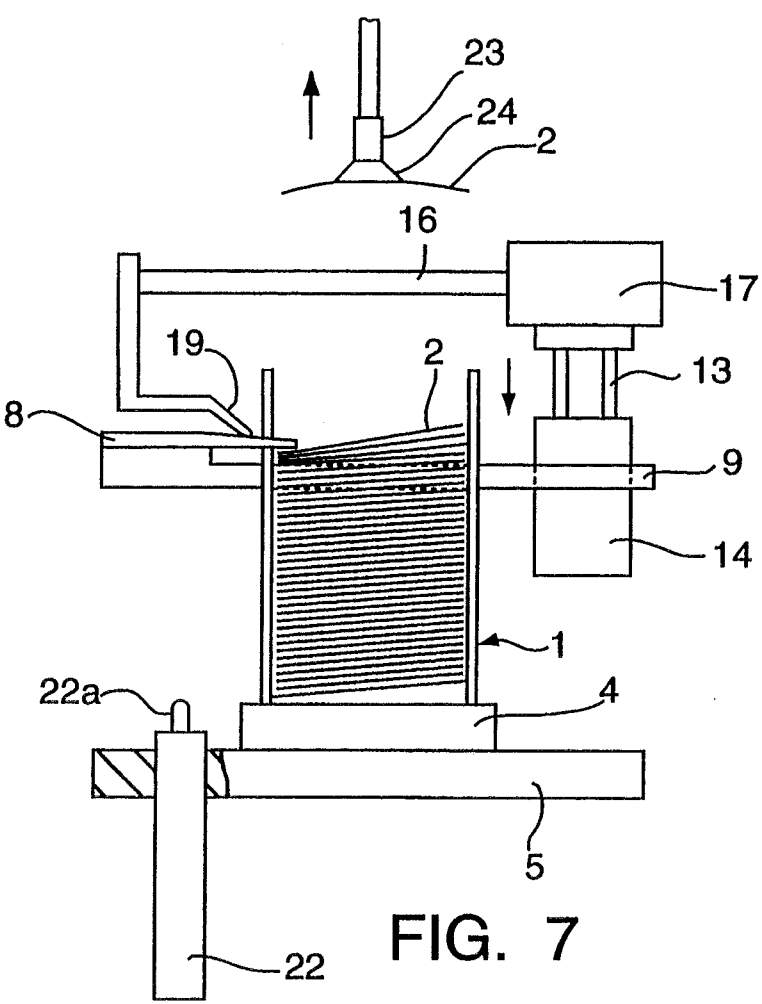
FIG. 7 is a view for explaining the operation of the label picking up device in FIG. 1.

After the vacuum suction unit 24 draws the uppermost label 2 by suction, the vacuum suction unit 24 rises so as to transfer the label 2 to a given position in the sewing machine as illustrated in FIG. 7. When the label 2 is transferred to the given place in the sewing machine, the vacuum suction unit 24 stops sucking to leave the label 2 at the given place.

Figure 8:
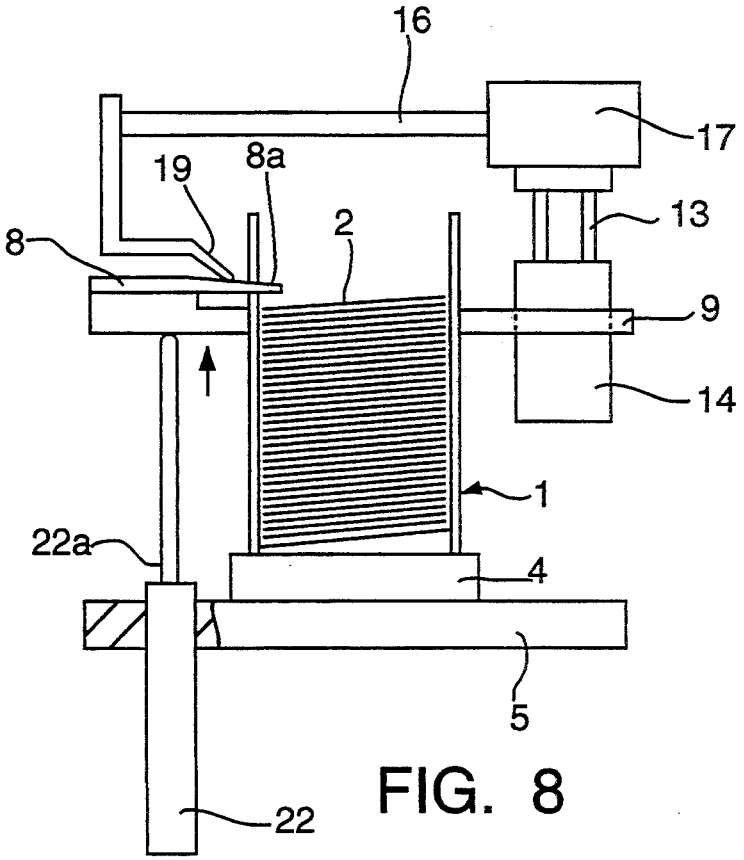
FIG. 8 is a view for explaining the operation of the label picking up device in FIG. 1.

While the vacuum suction unit 24 transfers the uppermost label 2 sucked thereto, the pneumatic cylinder device 22 is operated forward to push up the supporting plate 9 by way of the piston rods 22*a* by a given distance so as to raise the pressure member 8 as illustrated in FIG. 8. As a result, the second and later labels 2 are released from being pressed down by the contacting portion 8*a* of the presser member 8 so that the second and later labels 2 which has been misaligned by the frictional operation of the peel-off plate 19 are elastically restored to their normal positions.

Figure 9:
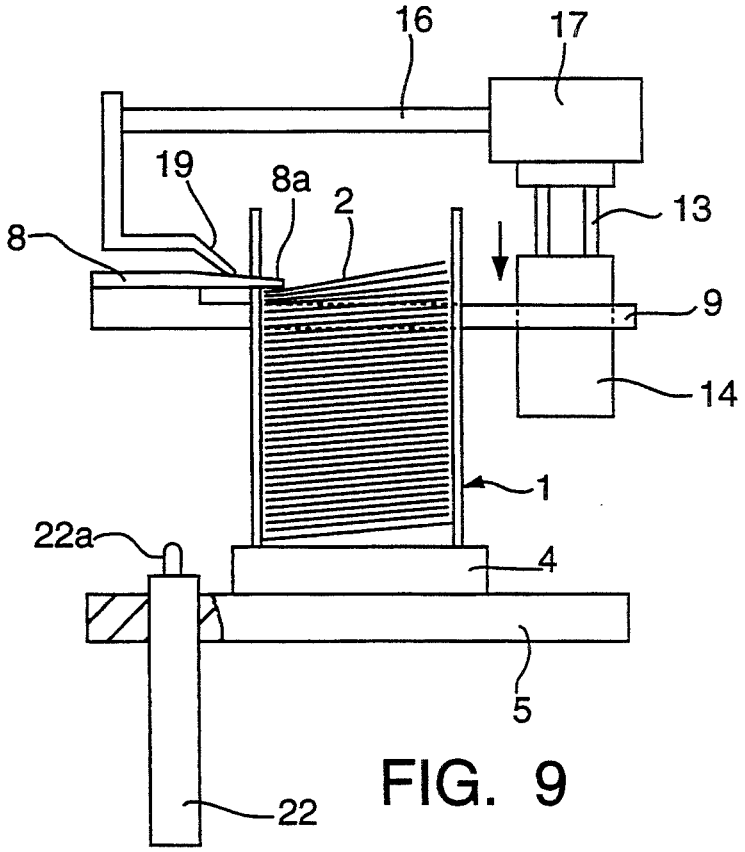
FIG. 9 is a view for explaining the operation of the label picking up device in FIG. 1.

When the pneumatic cylinder device 22 is operated backward as illustrated in FIG. 9, the piston rods 22*a* are lowered so that the contacting portion 8*a* of the presser member 8 presses down one end portion of the second and later labels 2 at a given pressure to restore the same to their original states. In this way the label picking up device repeats this operation successively.

Whereas the traveling distance of the peel-off plate 19 which is raised by the pneumatic cylinder device 14 in order to restore the uppermost label 2 from the bent state after it is frictionally pushed out may be always constant regardless of the height of the labels 2 piled in the storage space 1*e* in case that the labels 2 are of same kind. It is because the presser member 8 is not displaced relative to the peel-off plate 19 during the descent of the presser member 8 since the pneumatic cylinder device 14 is fixed to the supporting plate 9, which lowers together with the presser member 8 gradually lowering in accordance with the height of the labels 2 piled in the storage space 1*e*. It is possible to properly adjust the pressure applied to the upper surface of one end portion of the label 2 by the contacting portion 8*a* of the presser member 8 according to the kind of the label 2 by way of putting a suitable weight on the supporting plate 9.

As understood from the above description, since the label picking up device according to the present invention previously releases the uppermost label from being pressed down by a presser member by way of the frictional operation of a peel-off plate before the same is drawn by a vacuum suction unit and the second and later labels are pressed down by the presser member so as to be separated from the uppermost label with certainty when the uppermost label is drawn by the vacuum suction unit, it has an excellent effect that the uppermost label alone can be drawn by suction with certainty and moreover can be supplied to a given sewing position regardless of the weight of the label, the air permeability of material thereof, etc.

What is claimed is:

1. A label picking up device for drawing by suction the uppermost label from a plurality of labels accommodated in a pile in a label case by way of a vacuum suction unit and supplying the sucked label to a given sewing machine, said device comprising:

a presser member having a contact portion with a tip end, the portion gradually thinning toward the tip end, said member being inserted into the label case through a vertical opening portion formed on a side wall thereof for pressing the tip end of the member on top of the pile of labels at an edge portion thereof in the lable case from above at a given pressure to cause the too label to extend inclinedly upward from the edge portion; and a peel off plate slideably disposed above the member, said plate having a downwardly curved tip end, said plate being slidably moved over the member after the top label is inclined so that the tip end of the plate extends beyond the tip end of the member to engage the top label and push it out from the label pile.

2. The device of claim 1 wherein the downwardly curved tip end of the plate is covered with rubber and frictionally engages the top table.

* * * * *

UNITED STATES PATENT AND TRADEMARK OFFICE

CERTIFICATE OF CORRECTION

PATENT NO. : 5,431,531

DATED : July 11, 1995

INVENTOR(S) : Masayuki Nozawa

It is certified that error appears in the above-identified patent and that said Letters Patent is hereby corrected as shown below:

Claim 1

Column 6, Line 54, "too" should be --top--.

Signed and Sealed this

Nineteenth Day of September, 1995

*Attest:*

Bruce Lehman

BRUCE LEHMAN

*Attesting Officer*

*Commissioner of Patents and Trademarks*